US008995671B2

(12) United States Patent
Nakadai et al.

(10) Patent No.: US 8,995,671 B2
(45) Date of Patent: Mar. 31, 2015

(54) SOUND PROCESSING DEVICE, SOUND PROCESSING METHOD, AND SOUND PROCESSING PROGRAM

(75) Inventors: Kazuhiro Nakadai, Wako (JP); Ince Gokhan, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 455 days.

(21) Appl. No.: 13/543,125

(22) Filed: Jul. 6, 2012

(65) Prior Publication Data

US 2013/0010974 A1 Jan. 10, 2013

Related U.S. Application Data

(60) Provisional application No. 61/504,755, filed on Jul. 6, 2011.

(51) Int. Cl.
*H04R 29/00* (2006.01)
*H04R 3/00* (2006.01)
*G10L 21/0208* (2013.01)

(52) U.S. Cl.
CPC ..... *H04R 3/00* (2013.01); *G10L 21/0208* (2013.01)
USPC ..... 381/56; 700/245

(58) Field of Classification Search
CPC ..... H04N 11/00; G01H 3/14
USPC ..... 381/56; 700/245
See application file for complete search history.

(56) References Cited

U.S. PATENT DOCUMENTS

2006/0058920 A1 * 3/2006 Matsunaga et al. ..... 700/245

FOREIGN PATENT DOCUMENTS

JP 2010-271712 12/2010

OTHER PUBLICATIONS

Ince, Gokhan et al., "A Hybrid Framework for Ego Noise Cancellation of a Robot," 2010 IEEE International Conference on Robotics and Automation, pp. 3623-3628 (2010).
Ince, Gokhan et al., "Assessment of General Applicability of Ego Noise Estimation—Applications to Automatic Speech Recognition and Sound Source Localization," 2011 IEEE International Conference on Robotics and Automation, pp. 3517-3522 (2011).
Ince, Gokhan et al., "Assessment of Single-channel Ego Noise Estimation Methods," 2011 IEEE/RSJ International Conference on Intelligent Robots and Systems (IROS), pp. 106-111 (2011).
Ince, Gokhan et al., "Ego Noise Suppression of a Robot Using Template Subtraction," 2009 IEEE/RSJ International Conference on Intelligent Robots and Systems (IROS), pp. 199-204 (2009).

* cited by examiner

*Primary Examiner* — Simon King
(74) *Attorney, Agent, or Firm* — Nelson Mullins Riley & Scarborough LLP; Anthony A. Laurentano

(57) ABSTRACT

A sound processing device includes a storage unit configured to store first operation data corresponding to a motion of a mechanical apparatus and a first sound feature value corresponding to the motion in correlation with each other, a noise estimating unit configured to estimate a third sound feature value corresponding to a noise component based on a second sound feature value corresponding to an acquired sound signal, a sound feature value processing unit configured to calculate a target sound feature value from which the noise component is removed based on the second sound feature value and the third sound feature value, and an updating unit that updates the first sound feature value stored in the storage unit based on detected second operation data and the third sound feature value estimated by the noise estimating unit.

7 Claims, 12 Drawing Sheets

FIG. 14

| INDEX VALUE | CONDITION (1) | | | | CONDITION (2) | | | |
|---|---|---|---|---|---|---|---|---|
| | NON-PROCESSED | HRLE | TE | EMBODIMENT | NON-PROCESSED | HRLE | TE | EMBODIMENT |
| NNEE[dB] | — | -4.84 | -5.06 | **-6.84** | — | -4.92 | -5.06 | **-6.84** |
| LSD[dB] | 11.2 | 10.2 | 8.73 | **8.18** | 9.7 | 8.94 | 8.51 | **8.03** |
| SNR[dB] | -3.00 | -1.2 | 2.05 | **2.43** | 3.00 | 3.96 | **5.49** | 5.24 |
| WCR [%] | 28.3 | 47.2 | 58.7 | **69.9** | 78.0 | 84.1 | 87.4 | **89.3** |

FIG. 15

| INDEX VALUE | CONDITION (3) | | | | CONDITION (4) | | | |
|---|---|---|---|---|---|---|---|---|
| | NON-PROCESSED | HRLE | TE | EMBODIMENT | NON-PROCESSED | HRLE | TE | EMBODIMENT |
| LSD[dB] | 12.6 | 10.0 | 9.02 | **8.66** | 14.0 | 9.93 | 10.4 | **9.23** |
| SNR[dB] | -3.1 | -0.75 | 1.97 | **2.61** | -3.2 | -0.76 | 2.23 | **2.45** |
| WCR [%] | 25.5 | 42.1 | 64.1 | **64.6** | 22.8 | 38.2 | 55.8 | **59.9** |

SOUND PROCESSING DEVICE, SOUND PROCESSING METHOD, AND SOUND PROCESSING PROGRAM

CROSS REFERENCE TO RELATED APPLICATIONS

This is a non-provisional patent application claiming benefit from U.S. provisional patent application Ser. No. 61/504,755, filed Jul. 6, 2011, the contents of which are entirely incorporated herein by reference.

BACKGROUND OF THE INVENTION

1. Field of the Invention

The present invention relates to a sound processing device, a sound processing method, and a sound processing program.

2. Description of Related Art

A mechanical apparatus having a power source such as a motor, for example, a robot, generates sound due to a motion. A microphone built in or disposed proximal to the mechanical apparatus receives the sound of the mechanical apparatus along with a target sound such as speech uttered by a person. Such sound is referred to as ego-noise. In order to utilize the target sound received through the use of the microphone, it is necessary to reduce or remove the ego-noise of the mechanical apparatus. For example, when performing speech recognition on a target sound, it is not possible to guarantee a given recognition rate without reducing the ego-noise. Therefore, techniques of reducing ego-noise have been proposed in the past.

For example, in a sound data processing device described in JP-A-2010-271712, an operating state of a mechanical apparatus is acquired, sound data corresponding to the acquired operating state is acquired, sound data of a template of the operating state closest to the acquired operating state is searched for from a database which stores various operating states of the mechanical apparatus and corresponding sound data in a unit time, and the sound data of the template of the operating state closest to the acquired operating state is subtracted from the acquired sound data to calculate an output from which noise generated by the mechanical apparatus is reduced.

SUMMARY OF THE INVENTION

However, in the sound data processing device described in JP-A-2010-271712, templates prepared in advance are used. In order to guarantee noise-removing performance under various circumstances which vary frequently such as ambient noise, a lot of templates are necessary. On the other hand, it is not realistic to prepare enough templates to cope with all circumstances. As the number of templates increases, the processing time also increases. Accordingly, there is a problem in that it is not possible to secure noise-suppressing performance by only using a limited number of templates.

The invention is made in consideration of the above-mentioned problem and an object thereof is to provide a sound processing device, a sound processing method, and a sound processing program, which can improve noise-suppressing performance.

(1) The invention is made to solve the above-mentioned problem, and an aspect of the invention is a sound processing device including: a storage unit configured to store first operation data corresponding to a motion of a mechanical apparatus and a first sound feature value corresponding to the motion in correlation with each other; a noise estimating unit configured to estimate a third sound feature value corresponding to a noise component based on a second sound feature value corresponding to an acquired sound signal; a sound feature value processing unit configured to calculate a target sound feature value from which the noise component is removed based on the second sound feature value and the third sound feature value; and an updating unit configured to update the first sound feature value stored in the storage unit based on detected second operation data and the third sound feature value estimated by the noise estimating unit.

(2) In the sound processing device, the updating unit may be configured to select the first sound feature value stored in the storage unit based on the second operation data and may update the first sound feature value to a value obtained by multiplying the first sound feature value and the third sound feature value by corresponding weighting coefficients and adding the multiplied values.

(3) In the sound processing device, the updating unit may be configured to store the second operation data and the third sound feature value estimated by the noise estimating unit in the storage unit in correlation with each other when the degree of similarity between the second operation data and the first operation data stored in the storage unit is lower than a predetermined degree of similarity.

(4) The sound processing device may further include a speech determining unit configured to determine whether the sound signal is a speech signal or a non-speech signal, the noise estimating unit may include a stationary noise estimating unit configured to estimate a sound feature value of a stationary noise component based on the sound signal when the speech determining unit determines that the sound signal is a non-speech signal, and the updating unit may be configured to update the first sound feature value based on a non-stationary component from which the sound feature value of the stationary noise component estimated by the stationary noise estimating unit based on the second sound feature value as the noise component is removed.

(5) The sound processing device may further include a motion detecting unit configured to determine whether or not an instruction data corresponds to a motion causing the mechanical apparatus to generate ego-noise when the instruction data related to the motion is input to the mechanical apparatus, the noise estimating unit may be configured to estimate the third sound feature value based on the second sound feature value when the motion detecting unit determines that the instruction data corresponds to the motion causing the mechanical apparatus to generate ego-noise, and the updating unit may be configured to update the first sound feature value based on a component obtained by subtracting the third sound feature value estimated by the noise estimating unit from the second sound feature value.

(6) Another aspect of the invention is a sound processing method in a sound processing device having a storage unit configured to store first operation data corresponding to a motion of a mechanical apparatus and a first sound feature value corresponding to the motion in correlation with each other, including the steps of: estimating a third sound feature value corresponding to a noise component based on a second sound feature value corresponding to an acquired sound signal; calculating a target sound feature value from which the noise component is removed based on the second sound feature value and the third sound feature value; and updating the first sound feature value stored in the storage unit based on detected second operation data and the third sound feature value.

(7) Another aspect of the invention is a sound processing program causing a computer of a sound processing device, which has a storage unit configured to store first operation data corresponding to a motion of a mechanical apparatus and a first sound feature value corresponding to the motion in correlation with each other, to perform the steps of: estimating a third sound feature value corresponding to a noise component based on a sound feature value of an acquired sound signal; calculating a target sound feature value from which the noise component is removed based on a second sound feature value corresponding to the sound signal and the third sound feature value; and updating the first sound feature value stored in the storage unit based on detected second operation data and the third sound feature value.

According to the above-mentioned aspects of (1), (6), and (7), since the updated sound feature value of a noise component is used to remove noise, it is possible to improve noise-removing performance.

According to the configuration of (2), it is possible to make both adaptability to a variation in noise characteristics and stability of a motion compatible with each other.

According to the configuration of (3), it is possible to improve adaptability to a sudden variation in noise characteristics.

According to the configuration of (4), it is possible to improve adaptability to a variation in non-stationary noise characteristics.

According to the configuration of (5), it is possible to improve adaptability to ego-noise generated by a motion of the mechanical apparatus based on an instruction to the mechanical apparatus to be controlled.

BRIEF DESCRIPTION OF THE DRAWINGS

FIG. 14 is a table illustrating an example of a test result.

FIG. 15 is a table illustrating another example of the test result.

DETAILED DESCRIPTION OF THE INVENTION

First Embodiment

Hereinafter, a first embodiment of the invention will be described in detail with reference to the accompanying drawings.

Figure 1:
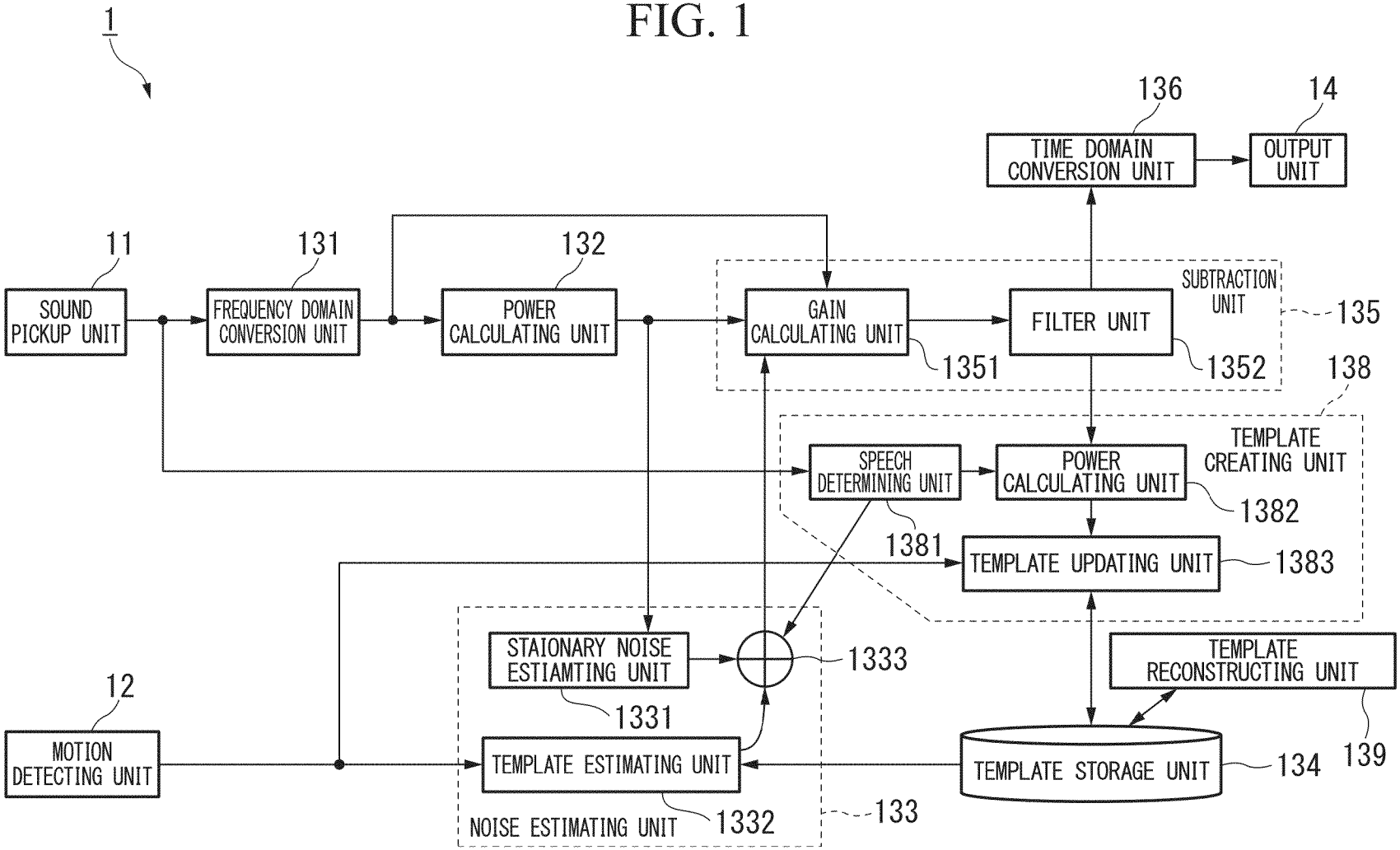
FIG. 1 is a diagram schematically illustrating the configuration of a sound processing device according to a first embodiment of the invention.

FIG. 1 is a diagram schematically illustrating the configuration of a sound processing device 1 according to this embodiment.

The sound processing device 1 includes a sound pickup unit 11, a motion detecting unit 12, a frequency domain conversion unit 131, a power calculating unit 132, a noise estimating unit 133, a template storage unit 134, a subtraction unit 135, a time domain conversion unit 136, a template creating unit 138, a template reconstructing unit 139, and an output unit 14.

In the sound processing device 1, the template storage unit 134 stores operation data indicating a motion of a mechanical apparatus and a spectrum of the motion in correlation with each other and the noise estimating unit 133 estimates a spectrum of a noise based on an input (acquired) sound signal and input (detected) operation data. In the sound processing device 1, the subtraction unit 135 subtracts the estimated spectrum of noise from the spectrum of the input sound signal and calculates an estimated target spectrum and creates a target sound signal in the time domain based on the calculated estimated target spectrum. On the other hand, the sound processing device 1 determines whether the input sound signal is a speech signal or a non-speech signal other than the speech signal, and calculates a spectrum of a non-stationary noise component based on the spectrum of the input sound signal when it is determined that the input sound signal is a non-speech signal. The sound processing device 1 updates a sound feature value stored in the template storage unit 134 based on the input operation data and a sound feature value of the non-stationary noise component.

The sound pickup unit 11 creates a sound signal y(t) as an electrical signal based on received sound waves and outputs the created sound signal y(t) to the frequency domain conversion unit 131 and the template creating unit 138. Here, t represents the time. The sound pickup unit 11 is, for example, a microphone recording a sound signal of an audible frequency band (20 Hz to 20 kHz).

The motion detecting unit 12 creates a motion signal (operation data) indicating a motion of the mechanical apparatus and outputs the created motion signal to the noise estimating unit 133 and the template creating unit 138. The motion detecting unit 12 creates a motion signal of the mechanical apparatus such as a robot equipped with the sound processing device 1. Here, the motion detecting unit 12 includes, for example, J encoders (position sensors) (where J is an integer greater than 0, for example, 30) and the encoders are mounted on motors (drivers) of the mechanical apparatus and measure angular positions $\theta_j(l)$ of corresponding joints. Here, j is an index of an encoder and is an integer greater than 0 and less than or equal to J, and l is an index representing the frame time. The motion detecting unit 12 calculates an angular velocity $\theta'_j(l)$ which is a time derivative and an angular acceleration $\theta''_j(l)$ which is a time derivative of the angular velocity for a measured angular position $\theta_j(l)$. The motion detecting unit 12 integrates the angular position $\theta_j(l)$, the angular velocity $\theta'_j(l)$, and the angular acceleration $\theta''_j(l)$ of each encoder over all the encoders to construct a feature vector F(l). The feature vector F(l) is a 3J-dimension vector $[\theta_1(l), \theta'_1(l), \theta''_1(l), \theta_2(l), \theta'_2(l), \theta''_2(l), \ldots, \theta_J(l), \theta'_J(l), \theta''_J(l))]$ indicating an operating state. The motion detecting unit 12 creates a motion signal indicating the constructed feature vector F(l).

The frequency domain conversion unit 131 converts the sound signal y(t) input from the sound pickup unit 11 and expressed in the time domain into a complex input spectrum Y(k, l) expressed in the frequency domain. Here, k represents an index (frequency bin) indicating a frequency. The frequency domain conversion unit 131 performs a discrete Fourier transform (DFT) on the sound signal, for example, using Equation 1 for each frame 1.

$$Y(k, l) = \sum_{t=0}^{W-1} y(t + lM)w(t)\exp\{j(2\pi / W)tk\} \tag{1}$$

Here, w(t) is a window function, for example, a Hamming window. W is an integer indicating a window length. M represents a shift length, that is, the number of samples by which a frame to be processed is shifted at a time.

The frequency domain conversion unit 131 outputs the converted complex input spectrum Y(k, l) to the power calculating unit 132 and the subtraction unit 135.

The power calculating unit 132 calculates the power spectrum $|Y(k, l)|^2$ of the complex input spectrum Y(k, l) input from the frequency domain conversion unit 131. Here, |AA| represents the absolute value of a complex number AA. The power calculating unit 132 outputs the calculated power spectrum $|Y(k, l)|^2$ to the subtraction unit 135 and the noise estimating unit 133.

The noise estimating unit 133 includes a stationary noise estimating unit 1331, a template estimating unit 1332, and an addition unit 1333.

The stationary noise estimating unit 1331 recursively averages the power spectrum $|Y(k, l)|^2$ input from the power calculating unit 132. Accordingly, the stationary noise estimating unit 1331 calculates a power spectrum $\lambda_{SNE}(k, l)$ of a stationary portion of noise.

In the following description, the power spectrum $\lambda_{SNE}(k, l)$ may be referred to as a power spectrum $\lambda_{SNE}(k, l)$ of a stationary portion or a stationary noise level. Here, the stationary noise estimating unit 1331 calculates a stationary noise level $\lambda_{SNE}(k, l)$, for example, using an HRLE (Histogram-based Recursive Level Estimation) method. Through the use of the HRLE method, a histogram (frequency distribution) of the power spectrum $|Y(k, l)|^2$ in a logarithmic domain is calculated and the stationary noise level $\lambda_{SNE}(k, l)$ is calculated based on the calculated cumulative distribution and a predetermined cumulative frequency (percentile)×(for example, 50%). The process of calculating the stationary noise level $\lambda_{SNE}(k, l)$ using the HRLE method will be described later.

The stationary noise estimating unit 1331 is not limited to the HRLE method, but may calculate the stationary noise level $\lambda_{SNE}(k, l)$ using another method such as an MCRA (Minima-Controlled Recursive Average) method. The stationary noise estimating unit 1331 outputs the calculated stationary noise level $\lambda_{SNE}(k, l)$ to the addition unit 1333.

The template estimating unit 1332 estimates a power spectrum $\lambda_{TE}(k, l)$ of a non-stationary portion (non-stationary component) based on the motion signal input from the motion detecting unit 12 and outputs the estimated power spectrum $\lambda_{TE}(k, l)$ of the non-stationary component to the addition unit 1333.

In the following description, the power spectrum $\lambda_{TE}(k, l)$ of the non-stationary component may be referred to as anon-stationary noise level. Here, the template estimating unit 1332 selects a feature vector F'(l) stored in the template storage unit 134 based on the feature vector F(l) indicated by the input motion signal. The template storage unit 134 stores a feature vector F'(l) and a noise spectrum vector $|N'_n(k, l)|^2$ in correlation with each other as described later. In the following description, the set of the feature vector F'(l) and the noise spectrum vector $|N'_n(k,l)|^2$ corresponding thereto is referred to as a template. The process of selecting a feature vector F'(l) in the template estimating unit 1332 will be described later.

The template estimating unit 1332 may search for the feature vector F'(l) stored in the template storage unit 134 using an exhaustive key search method or a binary search method. When the binary search method is used, the feature vectors F'(l) construct a KD tree (K-Dimensional tree). The template estimating unit 1332 can reduce the amount of throughput more greatly using the binary search method than using the exhaustive key search method. The KD tree and the binary search method will be described later.

In order to select a feature vector F'(l) with the n-th smallest distance (where n is an integer greater than 1), the template estimating unit 1332 can perform the above-mentioned search with a feature vector F'(l) with the first to (n−1)-th smallest Euclidean distances excluded from the selection target.

A speech determination signal is input to the addition unit 1333 from the template creating unit 138. The speech determination signal is a signal indicating whether the input sound signal is a speech signal or a non-speech signal. When the sound determination signal indicates speech, the addition unit 1333 adds the stationary noise level $\lambda_{SNE}(k, l)$ input from the stationary noise estimating unit 1331 and the non-stationary power spectrum $\lambda_{TE}(k, l)$ input from the template estimating unit 1332. The addition unit 1333 outputs the noise power spectrum $\lambda_{tot}(k, l)$, which is created by addition, to the subtraction unit 135.

When the sound determination signal indicates non-speech, the addition unit 1333 outputs the stationary noise level $\lambda_{SNE}(k,l)$, which is input from the stationary noise estimating unit 1331, as the noise power spectrum $\lambda_{tot}(k, l)$ to the subtraction unit 135.

The subtraction unit (sound feature value processing unit) 135 includes a gain calculating unit 1351 and a filter unit 1352. As described below, the subtraction unit 135 estimates a spectrum (estimated target spectrum) of a speech from which a noise component is removed by subtracting the noise power spectrum $\lambda_{tot}(k, l)$ from the power spectrum $|Y(k, l)|^2$.

The gain calculating unit 1351 calculates a gain $G_{SS}(k, l)$, for example, using Equation 2 based on the power spectrum $|Y(k, l)|^2$ input from the power calculating unit 132 and the noise power spectrum $\lambda_{tot}(k, l)$ input from the addition unit 1333.

$$G_{SS}(k, l) = \max\left[\sqrt{\{|Y(k, l)|^2 - \lambda_{tot}(k, l)\} / |Y(k, l)|^2}\ , \beta\right] \tag{2}$$

In Equation 2, max(α, β) represents a function taking the larger of real numbers α and β. β is a flooring parameter indicating a predetermined minimum value. Here, the left side of the function max represents a square root of the ratio of a power spectrum from which noise is removed to a power spectrum from which noise is not removed, which is related to the frequency k in a frame 1. The gain calculating unit 1351 outputs the calculated gain $G_{SS}(k, l)$ to the filter unit 1352.

The filter unit 1352 multiplies the complex input spectrum Y(k, l) input from the frequency domain conversion unit 131 by the gain $G_{SS}(k, l)$ input from the gain calculating unit 1351 to calculate an estimated target spectrum X'(k, l). That is, the estimated target spectrum X'(k, l) represents a complex spectrum obtained by subtracting the noise spectrum from the input complex input spectrum Y(k, l). The filter unit 1352 outputs the calculated estimated target spectrum X'(k, l) to the time domain conversion unit 136 and the template creating unit 138.

The time domain conversion unit (speech calculating unit) 136 converts the estimated target spectrum X'(k, l) input from the filter unit 1352 into a target sound signal x'(t) in the time domain. Here, the time domain conversion unit 136 performs, for example, an inverse discrete Fourier transform (IDFT) on the estimated target spectrum X'(k, l) for each frame 1 to calculate a target sound signal x'(t). The time domain conversion unit 136 outputs the converted target sound signal x'(t) to the output unit 14. That is, the estimated target spectrum X'(k, l) is the spectrum of the target sound signal x'(t).

The output unit 14 outputs the target sound signal x'(t) input from the time domain conversion unit 135 to the outside of the sound processing device 1.

The template creating unit 138 includes a speech determining unit 1381, a power calculating unit 1382, and a template updating unit 1383.

The speech determining unit 1381 performs voice activity detection (VAD) on the sound signal y(t) input from the sound pickup unit 11. The speech determining unit 1381 performs the voice activity detection for each voice-active segment. The voice-active segment is an interval interposed between an onset and a decay of an amplitude of a sound signal. The onset is a portion in which the power of the sound signal becomes greater than a predetermined power after a silent segment. The decay is a portion in which the power of the sound signal becomes smaller than a predetermined power before a silent segment. The speech determining unit 1381 determines that it is an onset, for example, when a power value of a time interval (for example, 10 ms) is smaller than a predetermined power threshold immediately before and is greater than the power threshold at the present. On the contrary, the speech determining unit 1381 determines that it is a decay when the power value is greater than a predetermined threshold immediately before and smaller than the power threshold at the present.

The speech determining unit 1381 determines that it is a speech segment when the number of zero crossings per unit time (for example, 10 ms) is greater than a predetermined number. The number of zero crossings means the number of times in which the amplitude of a sound signal crosses zero, that is, in which the amplitude changes from a negative value to a positive value or changes from a positive value to a negative value. The speech determining unit 1381 determines that it is a non-speech segment when the number of zero crossings is less than a predetermined number. The speech determining unit 1381 creates a speech determination signal indicating a speech signal when determining that it is a speech segment. The speech determining unit 1381 creates a speech determination signal indicating a non-speech signal when it is determined that it is a non-speech segment. The speech determining unit 1381 outputs the created speech determination signal to the addition unit 1333 and the power calculating unit 1382. When it is determined that it is a non-speech segment, the sound signal picked up by the sound pickup unit 11 includes mainly an ego-noise component generated by the mechanical apparatus.

The speech determination signal from the speech determining unit 1381 and the estimated target spectrum X'(k, l) from the filter unit 1352 are input to the power calculating unit 1382. When the sound determination signal indicates a non-speech signal, the input estimated target spectrum X'(k, l) is a non-stationary component $N'_n(k, l)$ obtained by removing a stationary noise component from noise. In this case, the power calculating unit 1382 calculates the power spectrum $|N'_n(k, l)|^2$ of the non-stationary component $N'_n(k, l)$ and outputs the calculated power spectrum $|N'_n(k, l)|^2$ as the power spectrum $\lambda_{TE}(k, l)$ of the non-stationary component to the template updating unit 1383.

The power calculating unit 1382 does not output the power spectrum $|N'_n(k, l)|^2$ when the sound determination signal input from the speech determining unit 1381 indicates speech.

The template updating unit 1383 updates the templates stored in the template storage unit 134 based on the motion signal input from the motion detecting unit 12 and the power spectrum $\lambda_{TE}(k, l)$ of the non-stationary component input from the power calculating unit 1382. The process of updating the templates in the template updating unit 1383 will be described later.

The template reconstructing unit 139 reconstructs the KD tree every predetermined time interval $\tau$ for the feature vectors F'(l) for each template stored in the template storage unit 134. Through the use of this reconstruction, the recursive structure of the KD tree is restored, thereby preventing an increase in search time of the feature vectors F'(l). The reconstruction of the templates of the KD tree may be performed every frame 1, and $\tau$ may be a time interval, for example, 50 (ms) longer than the frame interval. Accordingly, it is possible to suppress an increase in processing load due to the updating of the templates. When the template estimating unit 1332 and the template updating unit 1383 search for the feature vectors F'(l), for example, in a round-robin manner without using the binary search method, the template reconstructing unit 139 may be skipped.

Stationary Noise Level Calculating Process

The process of calculating a stationary noise level $\lambda_{SNE}(k, l)$ using the HRLE method in the stationary noise estimating unit 1331 will be described below.

Figure 2:
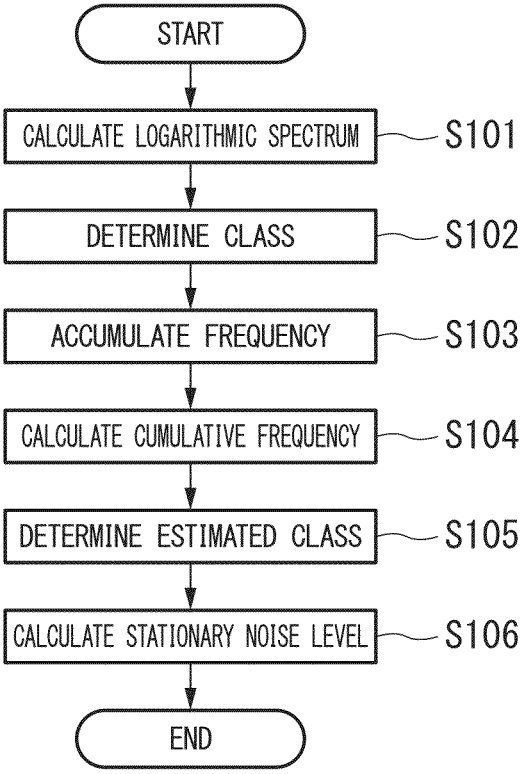
FIG. 2 is a flowchart illustrating the flow of processes of calculating a stationary noise level using an HRLE method.

FIG. 2 is a flowchart illustrating the flow of processes of calculating a stationary noise level $\lambda_{SNE}(k, l)$ using the HRLE method.

(Step S101) The stationary noise estimating unit 1331 calculates a log spectrum $Y_L(k, l)$ based on the power spectrum $|Y(k, l)|^2$. Here, $Y_L(k, l)=20 \log_{10}|Y(k, l)|$. Thereafter, the flow of processes goes to step S102.

(Step S102) The stationary noise estimating unit 1331 determines a class (bin) $I_y(k, l)$ to which the calculated log spectrum $Y_L(k, l)$ belongs. Here, $I_y(k, l)=\text{floor}(Y_L(k, l)-I_{min})/L_{step}$. The floor (BB) is a floor function taking the real number BB or the maximum integer less than the real number BB. $I_{min}$ and $L_{step}$ represent a predetermined minimum level and the level width for each class. Thereafter, the flow of processes goes to step S103.

(Step S103) The stationary noise estimating unit 1331 accumulates the frequency N(k, l) of a class $I_y(k, l)$ in the present frame 1. Here, $N(k, l, i)=\alpha N(k, l-1, i)+(1-\alpha)\delta(i-I_y(k, l))$. $\alpha$ is a time decay parameter and satisfies $\alpha=1-1/(T_r \cdot F_s)$. $T_r$ is a predetermined time constant and $F_s$ is a sampling frequency. $\delta(\ldots)$ is a Dirac's delta function. That is, the frequency N(k, l, i) is obtained adding $1-\alpha$ to the value, which is obtained by multiplying the frequency N(k, l−1, i) of the class $I_y(k, l)$ in the previous frame l−1 and decaying the resultant. Thereafter, the flow of processes goes to step S104.

(Step S104) The stationary noise estimating unit 1331 adds the frequencies N(k, l, i') of the lowest class 0 to the class i to calculate the cumulative frequency S(k, l, i). Thereafter, the flow of processes goes to step S105.

(Step S105) The stationary noise estimating unit 1331 sets the parameter i providing the cumulative frequency S(k, l, i) closest to the cumulative frequency $S(k, l, i_{max})\cdot x/100$ corresponding to the cumulative frequency x as an estimated parameter $I_x(k, l)$. That is, the estimated parameter $I_x(k, l)$ has the following relationship with the cumulative frequency S(k, l, i): $I_x(k, l)=\arg\min_1[S(k, l, I_{max})\cdot x/100-S(k, l, I)]$. Thereafter, the flow of processes goes to step S106.

(Step S106) The stationary noise estimating unit 1331 converts the estimated parameter $I_x(k, l)$ into a logarithmic level $\lambda_{HRLE}(k, l)$. Here, $\lambda_{HRLE}(k, l)=L_{min}+L_{step}\cdot I_x(k, l)$ is satisfied. The logarithmic level $\lambda_{HRLE}(k, l)$ is transformed to a linear domain to calculate the stationary noise level $\lambda_{SNE}(k, l)$. That is, $\lambda_{SNE}(k, l)=10^{(\lambda_{SNE}(k, l)/20)}$ is satisfied. Thereafter, the flow of processes is ended.

Process of Selecting Feature Vector

The process of selecting a feature vector F'(l) in the template estimating unit 1332 will be described below.

The template estimating unit 1332 selects a feature vector F'(l), for example, using a nearest neighbor search algorithm. In the nearest neighbor search algorithm, an Euclidean distance d(F(l), F'(l)) is calculated as an index value indicating the degree of similarity between the input feature vector F(l) and the stored feature vector F'(l). The Euclidean distance d(F(l), F'(l)) is expressed by Equation 3.

$$d(F(l), F'(l)) = \|F(l) - F'(l)\| = \sqrt{\sum_{j=1}^{3J} (F_j(l) - F'_j(l))^2} \tag{3}$$

In Equation 3, $F_j(l)$ and $F'_j(l)$ represent the j-th element values of the feature vectors F(l) and F'(l). The template estimating unit 1332 selects the feature vector F'(l) with the minimum Euclidean distance d(F(l), F'(l)) and reads the noise spectrum vector $|N'_n(k, l)|^2$ corresponding to the selected feature vector F'(l) from the template storage unit 134. The template estimating unit 1332 outputs the read noise spectrum vector $|N'_n(k, l)|^2$ as the power spectrum $\lambda_{TE}(k, l)$ of the non-stationary component to the addition unit 1333.

The template estimating unit 1332 may use, for example, a k-nearest neighbor algorithm (k-NN) to select the feature vector F'(l) stored in the template storage unit 134. Here, the template estimating unit 1332 calculates the Euclidean distance d(F(l), F'(l)) between the input feature vector F(l) and the stored feature vector F'(l). The template estimating unit 1332 selects the feature vector $F'^1(l)$ with the smallest Euclidean distance d(F(l), F'(l)) to the feature vector $F'^K(l)$ with the K-th smallest Euclidean distance d(F(l), F'(l)) (where K is an integer greater than 1). The template estimating unit 1332 calculates the power spectrums $\lambda^1_{TE}$ to $\lambda^K_{TE}$ of the selected K feature vectors $F'^1(l)$ to $F'^K(l)$ as expressed by Equation 4 and calculates the weighted average value $\lambda''_{TE}(k, l)$ of the calculated power spectrums $\lambda^1_{TE}$ to $\lambda^K_{TE}$.

$$\lambda''_{TE} = \sum_{n=1}^{K} w^n \lambda^n_{TE} \tag{4}$$

In Equation 4, $w^n$ is a weighting parameter of the n-th power spectrum $\lambda^n_{TE}$. The weighting parameter $w^n$ is expressed by Equation 5.

$$w^n = \left(1/d(F(l), F'^n(l)) \Big/ \sum_{n=1}^{K} 1/d(F(l), F'^n(l))\right) \tag{5}$$

That is, the weighting parameter $w^n$ is determined so that the total sum $E_{n=1}^{K} w^n$ of the reciprocals of the Euclidean distances d(F(l), F'(l)) related to the corresponding feature vectors $F'^n(l)$ is 1. The weighted average using the weighting parameter $w^n$ expressed by Equation 5 is referred to as an inverse distance weighted average (IDWA). Accordingly, a weighting parameter greater by the power spectrum $\lambda_{TE}$ related to the feature vector F'(l) approximating to the input feature vector F(l) is given.

The template estimating unit 1332 outputs the calculated weighted average $\lambda''_{TE}(k, l)$ as the power spectrum $\lambda_{TE}(k, l)$ of the non-stationary component to the addition unit 1333.

KD tree

The KD tree will be described below. The KD tree has a space-division data structure in which points (the feature vectors F'(l) in this example) in a multi-dimensional Euclidean space are classified. In the KD tree, for example, a median for each dimension of the feature vector F'(l) is selected and plane passing through the median and perpendicular to the coordinate axis of that dimension is defined as a divisional plane. That is, the KD tree has the following recursive structure.

(1) A feature vector F'(l) taking a median in a certain dimension n is defined as a root node (also referred to as a parent node). A feature vector F'(l) taking a value larger than the median in that dimension n and a feature vector F'(l) taking a value smaller than the median are classified as leaf nodes (also referred to as child nodes).

(2) A feature vector F'(l) taking a median in another dimension m' (for example, a dimension m+1) is defined as a root node for candidates of the leaf node taking a value larger than the median and candidates of the leaf node taking a value smaller than the median. That is, the root node defined for the dimension m' becomes a leaf node of the root node in the dimension n.

(3) Until the candidates of the leaf node do not remain, (1) and (2) are sequentially repeated while changing the dimension to be processed.

Therefore, the nodes from the root node (for example, a first dimension) as a start point to the leaf node of a terminal correspond to feature vectors F'(l), respectively. Any root node has two leaf nodes in principle. The leaf node of the terminal is a node not having a leaf node with respect to itself.

Structure information indicating indices indicating the feature vectors F'(l) corresponding to the root node as a start point and the root node and the leaf nodes of each dimension is stored as the information indicating the correspondence in the template storage unit 134.

Binary Search Method

The process of searching for a feature vector F'(l) using the binary search method in the template estimating unit 1332 will be described below.

Figure 3:
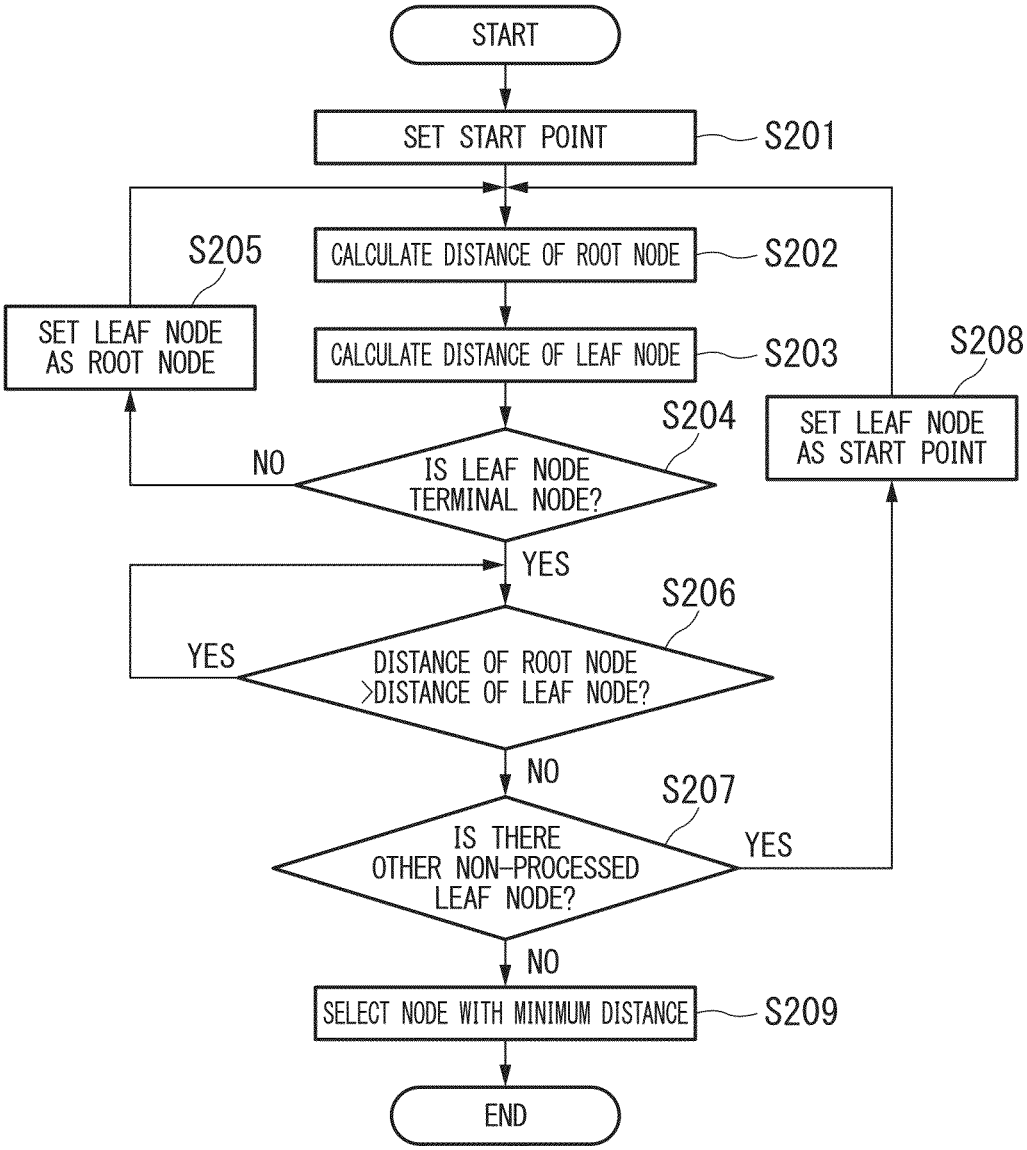
FIG. 3 is a flowchart illustrating the flow of processes of searching for a feature vector according to the first embodiment of the invention.

FIG. 3 is a flowchart illustrating the flow of processes of searching for a feature vector F'(l) according to this embodiment.

(Step S201) The template estimating unit 1332 sets a root node as a predetermined start point. Thereafter, the flow of processes goes to step S202.

(Step S202) The template estimating unit 1332 calculates the Euclidean distance d(F(l), F'(l)) (hereinafter, simply referred to as a distance) related to the feature vector F'(l) of the root node. Thereafter, the flow of processes goes to step S203.

(Step S203) The template estimating unit 1332 calculates the distance of the leaf nodes from the root node. Thereafter, the flow of processes goes to step S204.

(Step S204) The template estimating unit 1332 selects a leaf node with a less distance and determines whether or not the selected leaf node is a leaf node of a terminal. When it is determined that the selected leaf node is the leaf node of a terminal (YES in step S204), the flow of processes goes to step S206. When it is determined that the selected leaf node is not the leaf node of a terminal (NO in step S204), the flow of processes goes to step S205.

(Step S205) The template estimating unit 1332 determines the selected leaf node as a root node. Thereafter, the flow of processes goes to step S202.

(Step S206) The template estimating unit 1332 determines whether or not the distance related to the root node is greater than the distance related to the leaf node. Accordingly, it is determined whether another leaf node should be excluded from search targets. When it is determined that the distance related to the leaf node is greater (YES in step S206), the template estimating unit 1332 determines that the root node as a leaf node and repeats the process of step S206. When it is determined that the distance related to the leaf node is less than or equal to the distance related to the root node (NO in step S206), the flow of processes goes to step S207.

(Step S207) The template estimating unit 1332 determines whether or not there is a non-processed leaf node as the other leaf node related to the root node. When it is determined that there is such a leaf node (YES in step S207), the flow of processes goes to step S208. When it is determined that there is not such a leaf node (NO in step S207), the flow of processes goes to step S209.

(Step S208) The template estimating unit 1332 determines the other leaf node as the root node which is a start point and the flow of processes goes to step S202.

(Step S209) The template estimating unit 1332 selects the feature vector F'(l) having the calculated smallest distance. Thereafter, the flow of processes is ended.

Process of Updating Template

The process of updating templates will be described below. The template updating unit 1383 selects a feature vector F'(l) stored in the template storage unit 134 based on the feature vector F(l) indicated by the input motion signal. Here, the template updating unit 1383 selects, for example, a feature vector F'(l) having the smallest Euclidean distance d(F(l), F'(l)) from the feature vector F(l) using the above-mentioned search method. Hereinafter, the Euclidean distance related to the selected feature vector F'(l) is referred to as the minimum distance $d_{min}$(F(l), F'(l)).

The template updating unit 1383 determines whether the minimum distance $d_{min}$(F(l), F'(l)) is greater than or equal to a predetermined threshold value T. When it is determined that the minimum distance $d_{min}$(F(l), F'(l)) is greater than or equal to the threshold value T, the template updating unit 1383 creates a new template to correspond to a set of the feature vector F(l) indicated by the input motion signal and the input power spectrum $\lambda_{TE}$(k, l). The template updating unit 1383 stores the created template in the template storage unit 134.

When it is determined that the minimum distance $d_{min}$(F(l), F'(l)) is smaller than the threshold value T, the template updating unit 1383 reads a power spectrum $\lambda'_{TE}$(k, l−1) corresponding to the selected feature vector F'(l) from the template storage unit 134. Hereinafter, the read power spectrum $\lambda'_{TE}$(k, l−1) may be referred to as a stored power spectrum $\lambda'_{TE}$(k, l−1). The template updating unit 1383 weights the stored power spectrum $\lambda'_{TE}$(k, l−1) and the input power spectrum $\lambda_{TE}$(k, l−1) with weighting parameters η and 1−η, respectively, and adds the resultants to calculate an updated power spectrum $\lambda_{TE}$(k, l). Accordingly, it is possible to balance adaptability such as learning quality and stability such as robustness against errors.

$$\lambda_{TE}(k,l)=\eta\lambda'_{TE}(k,l-1)+(1-\eta)\lambda_{TE}(k,l) \quad (6)$$

The parameter η is referred to as a forgetting parameter. The parameter η is a real number greater than 0 and less than 1, for example, 0.9. The template updating unit 1383 uses a smaller parameter η when the adaptability is preferred, and uses a larger parameter η when the stability is preferred. The template updating unit 1383 stores the calculated updated power spectrum $\lambda_{TE}$(k, l) in the template storage unit 134 in correlation with the feature vector F'(l) related to the read power spectrum $\lambda'_{TE}$(k, l−1).

Template Updating Process

The template updating process according to this embodiment will be described below.

Figure 4:
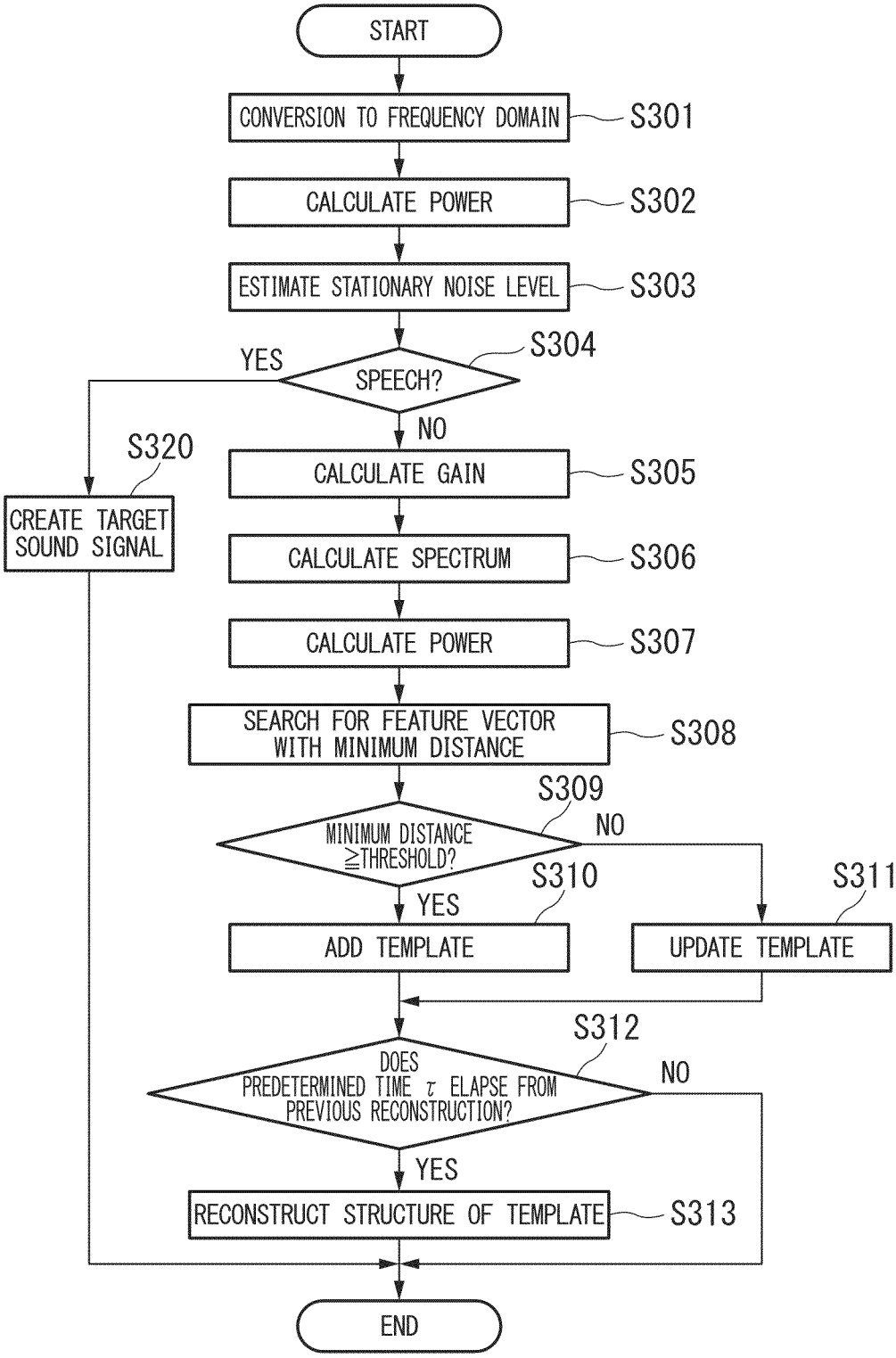
FIG. 4 is a flowchart illustrating the flow of a template updating process according to the first embodiment of the invention.

FIG. 4 is a flowchart illustrating the template updating process according to this embodiment.

(Step S301) The frequency domain conversion unit 131 converts the sound signal y(t) input from the sound pickup unit 11 into a complex input spectrum Y(k, l) expressed in the frequency domain. The frequency domain conversion unit 131 outputs the converted complex input spectrum Y(k, l) to the power calculating unit 132 and the subtraction unit 135. Thereafter, the flow of processes goes to step S302.

(Step S302) The power calculating unit 132 calculates the power spectrum $|Y(k, l)|^2$ of the complex input spectrum Y(k, l) input from the frequency domain conversion unit 131. The power calculating unit 132 outputs the calculated power spectrum $|Y(k, l)|^2$ to the subtraction unit 135 and the stationary noise estimating unit 1331. Thereafter, the flow of processes goes to step S303.

(Step S303) The stationary noise estimating unit 1331 calculates the stationary noise level $\lambda_{SNE}$(k, l), for example, using the HRLE method based on the power spectrum $|Y(k, l)|^2$ input from the power calculating unit 132. The stationary noise estimating unit 1331 outputs the calculated stationary noise level $\lambda_{SNE}$(k, l) to the addition unit 1333. Thereafter, the flow of processes goes to step S304.

(Step S304) The speech determining unit 1381 determines whether or not the sound signal y(t) input from the sound pickup unit 11 is in a speech segment. When it is determined that the sound signal is in the speech segment (YES in step S304), the speech determining unit 1381 creates a speech determination signal indicating speech and outputs the created speech determination signal to the addition unit 1333 and the power calculating unit 1382. Thereafter, the flow of processes goes to step S320. When it is determined that the sound signal is in a non-speech segment (NO in step S304), the speech determining unit 1381 creates a speech determination signal indicating the non-speech and outputs the created speech determining signal to the addition unit 1333 and the power calculating unit 1382. Thereafter, the flow of processes goes to step S305.

(Step S305) The gain calculating unit 1351 calculates a gain $G_{SS}$(k, l), for example, using Equation 2 based on the power spectrum $|Y(k, l)|^2$ input from the power calculating unit 132 and the noise power spectrum $\lambda_{tot}$(k, l) input from the addition unit 1333.

The gain calculating unit 1351 outputs the calculated gain $G_{SS}(k, l)$ to the filter unit 1352. Thereafter, the flow of processes goes to step S306.

(Step S306) The filter unit 1352 calculates an estimated target spectrum X'(k, l) by multiplying the complex input spectrum Y(k, l) input from the frequency domain conversion unit 131 by the gain $G_{SS}(k, l)$ input from the gain calculating unit 1351. The filter unit 1352 outputs the calculated estimated target spectrum X'(k, l) to the time domain conversion unit 136 and the power calculating unit 1382. Thereafter, the flow of processes goes to step S307.

(Step S307) The speech determination signal indicating a speech from the speech determining unit 1381 and the estimated target spectrum X'(k, l) from the filter unit 1352 are input to the power calculating unit 1382. The input estimated target spectrum X'(k, l) is a non-stationary component $N'_n(k, l)$ obtained by removing the stationary noise component from noise. The power calculating unit 1382 calculates the power spectrum $|N'_n(k, l)|^2$ of the non-stationary component $N'_n(k,l)$ and outputs the calculated power spectrum $|N'_n(k, l)|^2$ to the template updating unit 1383. Thereafter, the flow of processes goes to step S308.

(Step S308) The motion signal from the motion detecting unit 12 and the power spectrum $|N'_n(k, l)|^2$ as the power spectrum $\lambda_{TE}(k,l)$ of the non-stationary component from the power calculating unit 1382 are input to the template updating unit 1383. The template updating unit 1383 searches for the feature vector F(l) taking the minimum distance $d_{min}(F(l), F'(l))$ based on the feature vector F(l) indicated by the input motion signal. Thereafter, the flow of processes goes to step S309.

(Step S309) The template updating unit 1383 determines whether the minimum distance $d_{min}(F(l), F'(l))$ is greater than or equal to a predetermined threshold value T. When it is determined that the minimum distance $d_{min}(F(l), F'(l))$ is greater than or equal to the threshold value T (YES in step S309), the flow of processes goes to step S310. When it is determined that the minimum distance $d_{min}(F(l), F'(l))$ is smaller than the threshold value T (NO in step S309), the flow of processes goes to step S311.

(Step S310) The template updating unit 1383 stores the template in which the feature vector F(l) indicated by the input motion signal and the input power spectrum $\lambda_{TE}(k, l-1)$ are correlated with each other in the template storage unit 134 (addition of a template). Thereafter, the flow of processes goes to step S312.

(Step S311) The template updating unit 1383 reads the power spectrum $\lambda'_{TE}(k, l-1)$ corresponding to the selected feature vector F'(l) from the template storage unit 134. The template updating unit 1383 weights the stored power spectrum $\lambda'_{TE}(k, l-1)$ and the input power spectrum $\lambda_{TE}(k, l-1)$ with weighting parameters $\eta$ and $1-\eta$, respectively, for example, using Equation 6 and adds the resultants to calculate an updated power spectrum $\lambda_{TE}(k, l)$. The template updating unit 1383 stores the calculated updated power spectrum $\lambda_{TE}(k, l)$ in the template storage unit 134 in correlation with the feature vector F'(l) related to the read power spectrum $\lambda'_{TE}(k, l-1)$ (updating of a template). Thereafter, the flow of processes goes to step S312.

(Step S312) The template reconstructing unit 139 determines whether or not the time passing from the time point at which the KD tree of the feature vectors F'(l) is reconstructed most recently is greater than a predetermined time interval $\tau$. When it is determined that the elapsing time is greater than the time interval $\tau$ (YES in step S312), the flow of processes goes to step S313. When it is determined that the elapsing time is not greater than the time interval i (NO in step S312), the flow of processes is ended.

(Step S313) The template reconstructing unit 139 reconstructs the KD tree of the feature vectors F'(l) stored in the template storage unit 134. Thereafter, the flow of processes is ended.

(Step S320) The sound processing device 1 creates a target sound signal and then ends the flow of processes.

Process of Creating Target Sound Signal

The process (step S320) of creating a target sound signal in the sound processing device 1 will be described below.

Figure 5:
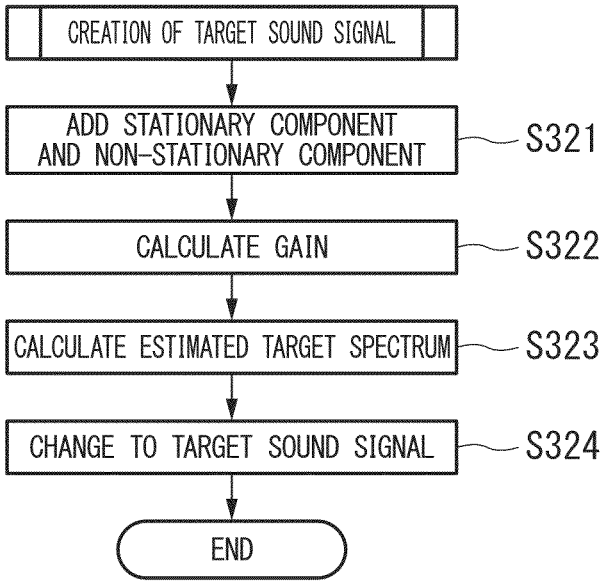
FIG. 5 is a flowchart illustrating the flow of a target sound signal creating process according to the first embodiment of the invention.

FIG. 5 is a flowchart illustrating the process of creating a target sound signal according to this embodiment.

(Step S321) The speech determination signal indicating a speech from the speech determining unit 1381 is input to the addition unit 1333. The addition unit 1333 adds the stationary noise level (stationary component) $\lambda_{SNE}(k, l)$ and the power spectrum $\lambda_{TE}(k, l)$ of the non-stationary component. The addition unit 1333 outputs the created noise power spectrum $\lambda_{tot}(k, l)$ to the gain calculating unit 1351.

The speech determination signal indicating a speech from the speech determining unit 1381 is also input to the power calculating unit 1382, but the power spectrum $|N'_n(k, l)|^2$ is not output to the template updating unit 1383. Accordingly, the processes of steps S308 to S311 are not performed.

Thereafter, the flow of processes goes to step S322.

(Step S322) The gain calculating unit 1351 calculates the gain $G_{SS}(k, l)$, for example, using Equation 2 based on the power spectrum $|Y(k, l)|^2$ input from the power calculating unit 132 and the noise power spectrum $\lambda_{tot}(k, l)$ input from the addition unit 1333. Thereafter, the flow of processes goes to step S323.

(Step S323) The filter unit 1352 calculates the estimated target spectrum X'(k, l) by multiplying the complex input spectrum Y(k, l) input from the frequency domain conversion unit 131 by the gain $G_{SS}(k, l)$ input from the gain calculating unit 1351. Accordingly, the noise power spectrum $\lambda_{tot}(k, l)$ is subtracted from the power spectrum $|Y(k, l)|^2$. The filter unit 1352 outputs the calculated estimated target spectrum X'(k, l) to the time domain conversion unit 136. Thereafter, the flow of processes goes to step S324.

(Step S324) The time domain conversion unit 136 converts the estimated target spectrum X'(k, l) input from the filter unit 1352 into a target sound signal x'(t) in the time domain and outputs the converted target sound signal x'(t) to the output unit 14. The output unit 14 outputs the target sound signal x'(t) input from the time domain conversion unit 136 to the outside of the sound processing device 1. Thereafter, the flow of processes is ended.

As described above, in this embodiment, when it is determined that the input sound signal is a non-speech signal, the power spectrum stored in the template storage unit 134 is updated based on the feature vector indicated by the input motion information and the power spectrum of the non-stationary noise component.

Accordingly, the power spectrum stored in the template storage unit 134 is updated to be adaptive to the non-stationariness of noise and the updated power spectrum is used for subtraction of the non-stationary noise. In this embodiment, the non-stationary noise is suppressed by using the updated power spectrum. In this embodiment, it is possible to effectively suppress noise, for example, even when the noise characteristics vary with the variation of a motor or an actuator with the lapse of time, without storing plural templates in the template storage unit 134 in the initial state.

Second Embodiment

A second embodiment of the invention will be described by referencing the same elements or processes as in the above-mentioned embodiment by the same reference numerals.

Figure 6:
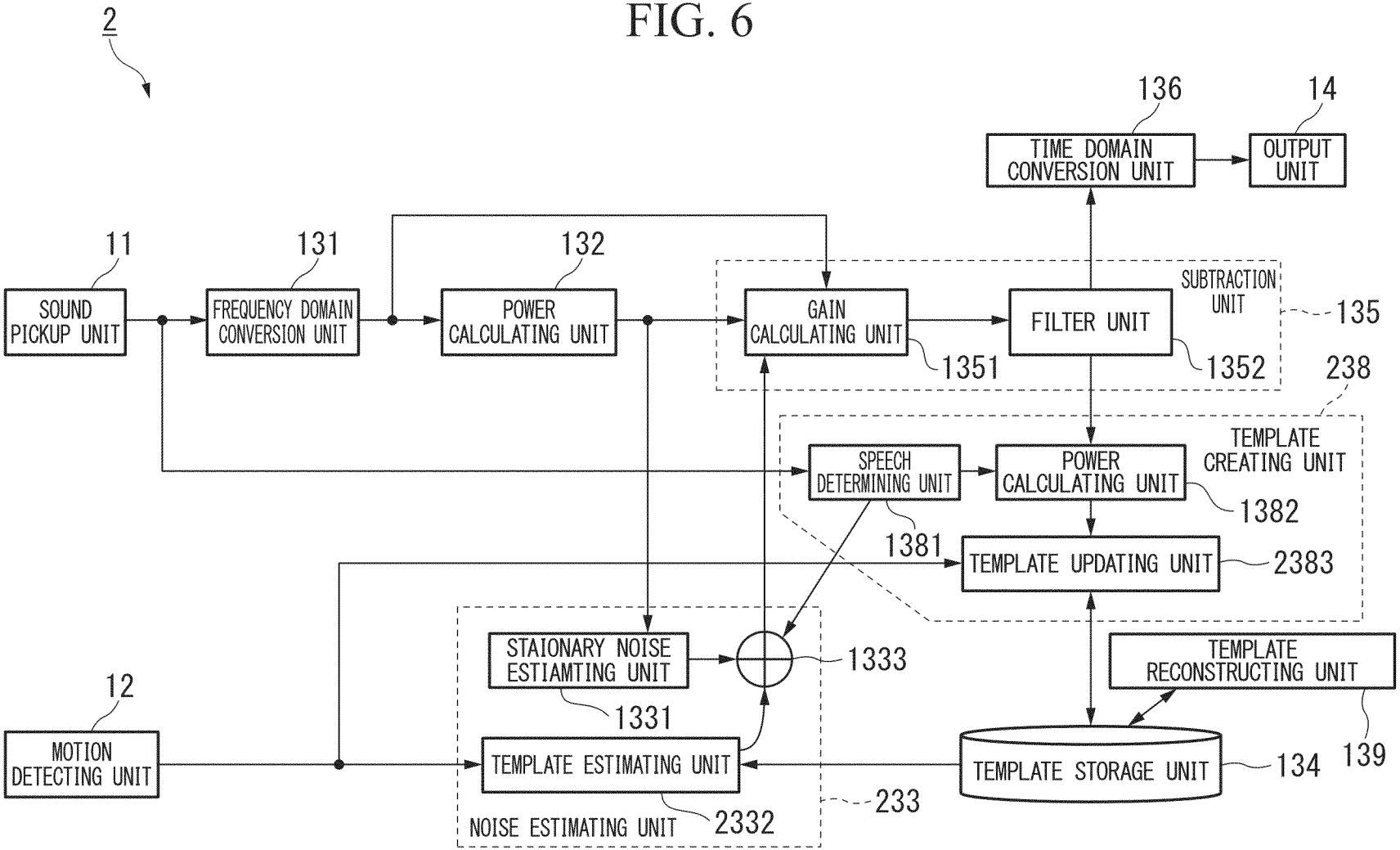
FIG. 6 is a diagram schematically illustrating the configuration of a sound processing device according to a second embodiment of the invention.

FIG. 6 is a diagram schematically illustrating the configuration of a sound processing device 2 according to this embodiment.

The sound processing device 2 includes a sound pickup unit 11, a motion detecting unit 12, a frequency domain conversion unit 131, a power calculating unit 132, a noise estimating unit 233, a template storage unit 134, a subtraction unit 135, a time domain conversion unit 136, a template creating unit 238, and an output unit 14. That is, the sound processing device 2 includes the noise estimating unit 233 and the template creating unit 238 instead of the noise estimating unit 133 and the template creating unit 138 of the sound processing device 1 (see FIG. 1).

The noise estimating unit 233 includes a stationary noise estimating unit 1331, a template estimating unit 2332, and an addition unit 1333. That is, the noise estimating unit 233 includes the template estimating unit 2332 instead of the template estimating unit 1332 (see FIG. 1) of the noise estimating unit 133.

The template creating unit 238 includes a speech determining unit 1381, a power calculating unit 1382, and a template updating unit 2383. That is, the template creating unit 238 includes the template updating unit 2383 instead of the template updating unit 1383 of the template creating unit 138 (see FIG. 1).

The template estimating unit 2332 and the template updating unit 2383 have the same configurations as the template estimating unit 1332 and the template updating unit 1383 and perform the same processes, respectively.

The template updating unit 2383 deletes the template not used for a predetermined time t' out of the templates stored in the template storage unit 134. The template used by the template estimating unit 2332 is a template related to the feature vector F'(l) of which the Euclidean distance d(F(l), F'(l)) from the input feature vector F(l) is the minimum. When the template estimating unit 2332 employs the K-NN method, the templates related to the feature vectors F'(l) of which the Euclidean distance d(F(l), F'(l)) are the first to K-th smallest are the used templates.

Therefore, when storing an added or updated template in the template storage unit 134, the template updating unit 2383 stores time information indicating the time in correlation with the template.

On the other hand, when determining the feature vector F'(l) with the minimum Euclidean distance d(F(l), F'(l)), the template estimating unit 2332 creates time information indicating the time. The template estimating unit 2332 updates the time information stored in the template storage unit 134 in correlation with the template related to the feature vector F'(l) with the created time information. When the K-NN method is employed, the template estimating unit 2332 updates the time information corresponding to the template related to the feature vectors F'(l) with the first to K-th smallest Euclidean distances d(F(l), F'(l)) with the created time information.

The template updating unit 2383 searches for the template corresponding to the elapsing time of which the time from the time indicated by the time information stored in the template storage unit 134 to the present time is greater than the predetermined time t' at a predetermined time interval (for example, a frame interval). When such a template is searched for, the template updating unit 2383 deletes the searched template from the template storage unit 134.

The template updating process according to this embodiment will be described below.

Figure 7:
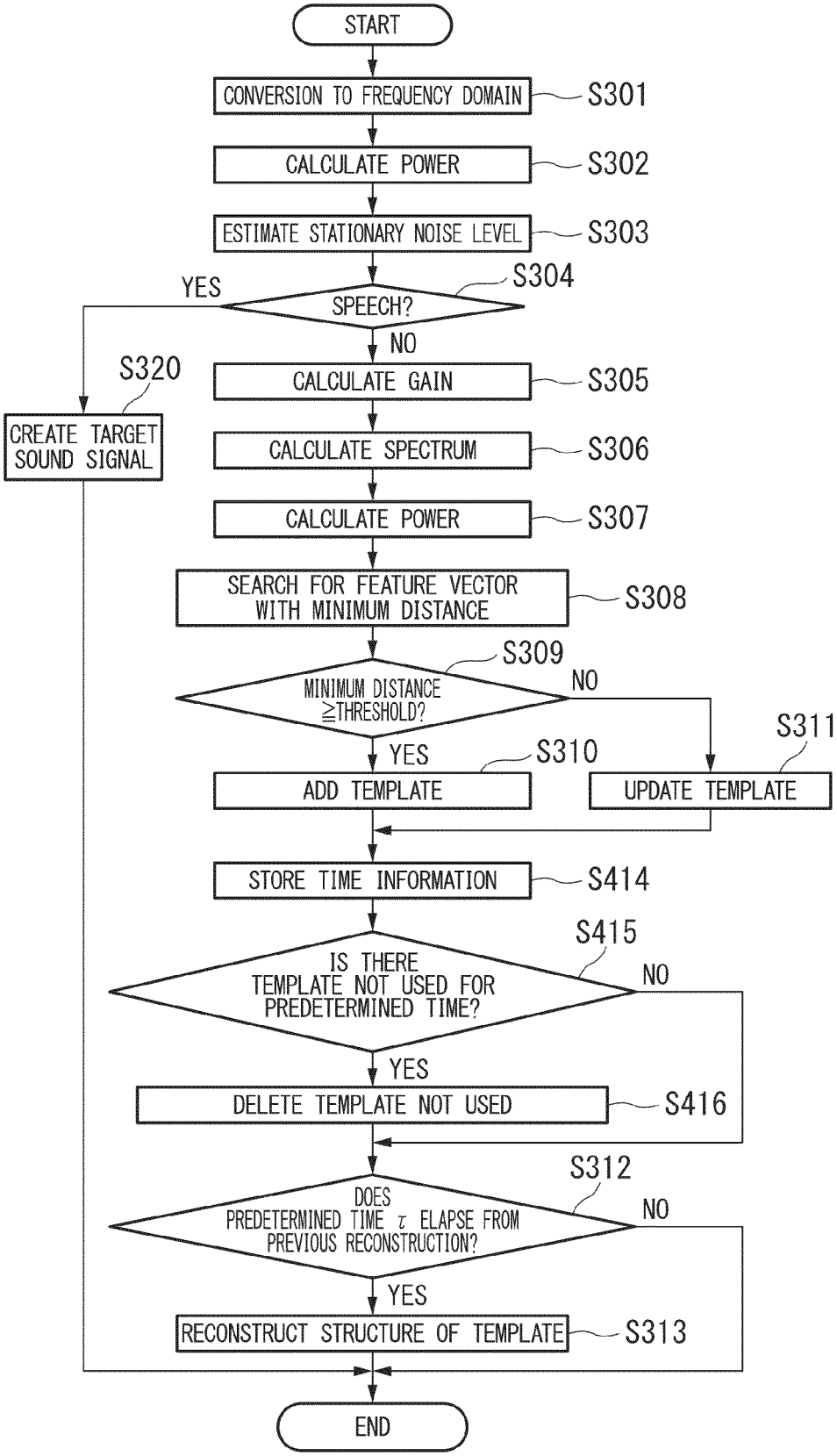
FIG. 7 is a flowchart illustrating the flow of the template updating process according to the second embodiment of the invention.

FIG. 7 is a flowchart illustrating the template updating process according to this embodiment.

The template updating process according to this embodiment performs the processes of steps S414 to S416 after the processes of steps S301 to S311 and then performs the processes of steps S312 and S313.

(Step S414) The template updating unit 2383 stores the time information indicating the time of addition or update in the template storage unit 134 in correlation with the added or updated template. Thereafter, the flow of processes goes to step S415.

(Step S415) The template updating unit 2383 determines whether or not a template of which the elapsing time from the time indicated by the time information storage in the template storage unit 134 to the present time is greater than the predetermined time t' is present. When it is determined that such a template is present (YES in step S415), the flow of processes goes to S416. When it is determined that such a template is not present (NO in step S415), the flow of processes goes to step S312.

(Step S416) The template updating unit 2383 deletes the template corresponding to the elapsing time greater than the predetermined time t' from the template storage unit 134. Thereafter, the flow of processes goes to step S312.

Although it has been state that a sound feature value in which the non-used time is greater than a predetermined time out of the sound feature values stored in the storage unit, this embodiment is not limited to this example. In this embodiment, the sound feature value of which the number of used times is smaller than a predetermined number of times out of the sound feature values stored in the storage unit may be deleted.

As described above, in this embodiment, the sound feature value of which the use frequency is smaller than a predetermined frequency out of the sound feature values stored in the storage unit is deleted. Accordingly, it is possible to reduce the number of sound feature values to be searched for without degrading the noise suppressing performance and thus to reduce the amount of throughput associated with the search of the sound feature value.

A test example where the sound processing device 1 (see FIG. 1) according to the first embodiment is activated will be described below. This test was performed under the following conditions. A microphone mounted on the outer periphery of a head of a humanoid robot was used as the sound pickup unit 11. The motion detecting unit 12 detected the motion of the arm (with four degrees of freedom) of the humanoid robot and the motion of the head (with two degrees of freedom). The arm and the head were made to move along a predetermined trace. The sound pickup unit 11 recorded ego-noise generated with such motions.

The sampling frequency of a sound signal was set to 16 kHz and the frame shaft was set to 10 ms. The threshold value T of the Euclidean distance was 0.0001, the updating interval $\tau$ of the KD tree was set to 50 ms, and the forgetting parameter $\eta$ was set to 0.9.

Before the test, the sound processing device was made to learn motor noise based on the motions of the robot and motion signals thereof for 200 seconds per 1 cycle. During the learning process, templates including a set of a feature vector based on the motion signal and a power spectrum based on the motor noise were created and the created templates were stored in the template storage unit 134. The learning process was repeated 20 times at most.

The learning quality in this embodiment will be described below. The estimation error and the number of templates were observed at the time of learning performed before the test as the index values of the leaning quality.

Figure 8:
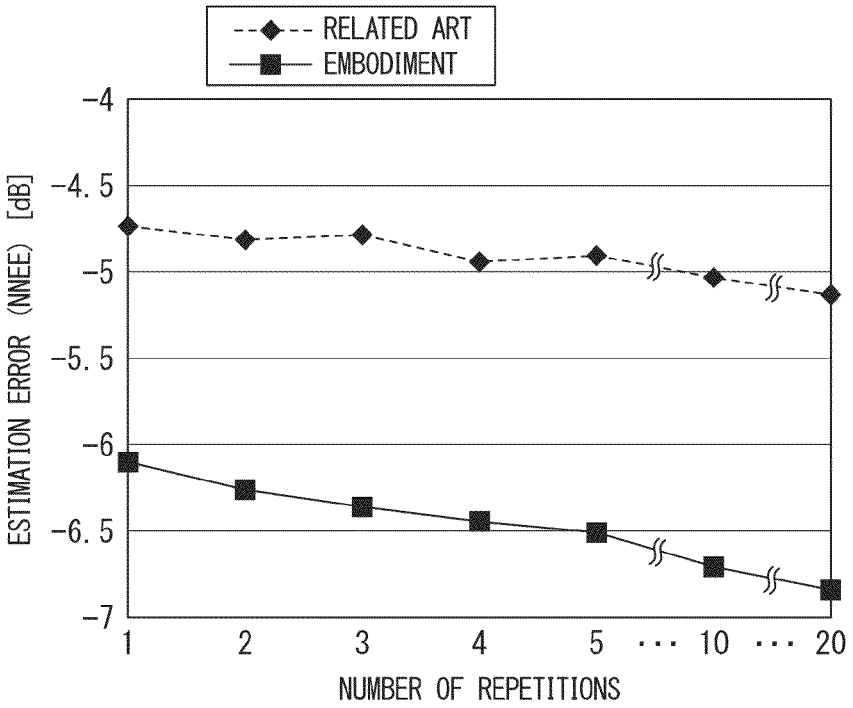
FIG. 8 is a diagram illustrating an example of an estimation error.

FIG. 8 is a diagram illustrating an example of the estimation error.

In FIG. 8, the horizontal axis represents the number of repetitions and the vertical axis represents the estimation error. The solid line represents the embodiment and the broken line represents the related art (template estimation (TE) method). The estimation error of the vertical axis is a normalized noise estimation error (NNEE). The NNEE is a value $\epsilon'$ obtained by averaging the index values $\epsilon(l)$ expressed by Equation 7 in the segment of a predetermined number of frames L.

$$\varepsilon(l) = 10\log\left(|N(k,l)|^2 - |N'(k,l)|^2 \Big/ \sum_{k=0}^{M} |N(k,l)|^2\right), \tag{7}$$

$$\varepsilon' = \frac{1}{L}\sum_{l=1}^{L}\varepsilon(l)$$

In Equation 7, $|N(k, l)|^2$ represents the power spectrum of actual noise. $|N'(k, l)|^2$ represents the power spectrum of the estimate noise in the embodiment or the related art. That is, the NNEE is a value obtained by normalizing the estimation error of the power spectrum of the noise with the power spectrum. As the NNEE decreases, the learning quality increases.

As shown in FIG. 8, the NNEE in this embodiment is lower than that in the related art by 1.7 dB. In this embodiment, the NNEE monotonously decreases from −6.1 dB to −6.9 dB over the number of repetitions of 1 to 20. On the contrary, in the related art, the NNEE decreases from −4.7 dB to −5.1 dB, but is not monotonous. FIG. 7 shows that the learning quality in this embodiment is superior to that in the related art.

Figure 9:
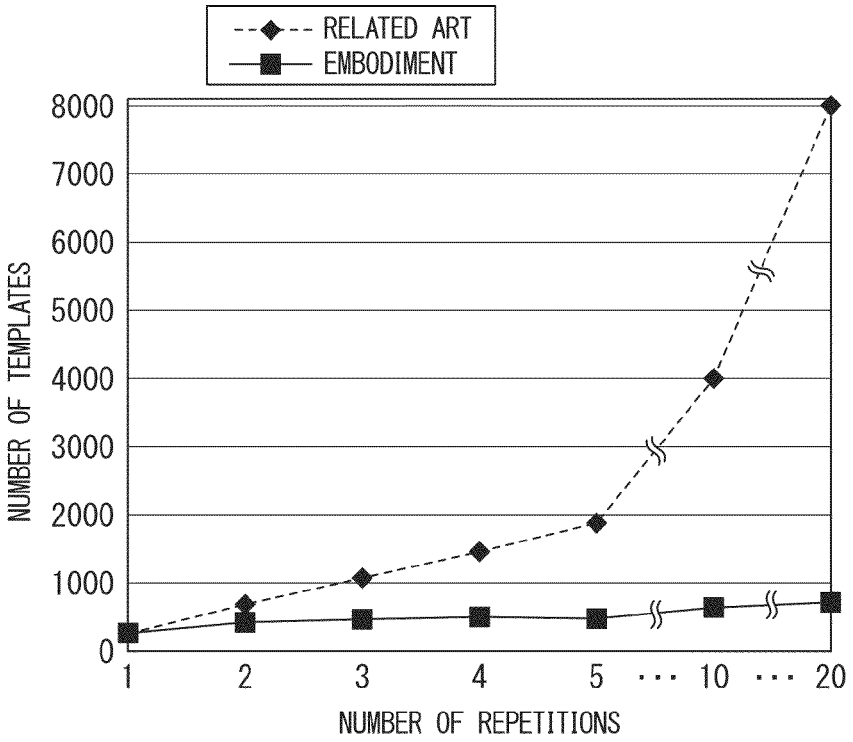
FIG. 9 is a diagram illustrating an example of the number of templates.

FIG. 9 is a diagram illustrating an example of the number of templates.

In FIG. 9, the horizontal axis represents the number of repetitions and the vertical axis represents the number of templates. The solid line represents the embodiment and the broken line represents the related art (template estimation (TE) method). In FIG. 9, the number of templates means the number of templates stored for use in the noise estimation in the embodiment and the related art. In this embodiment, the number of template is the number of templates stored in the template storage unit 134.

The number of templates increases from 200 to 800 over the number of repetitions of 1 to 20 in this embodiment, but increases from 200 to 8,000 in the related art. Paying attention to the number of repetitions 20 the number of templates in this embodiment is 1/10 in the related art. In this embodiment, since the templates are updated depending on the surroundings, it is possible to suppress the unnecessary increases of the number of templates, thereby reducing the number of processes related to the search of templates.

The spectrogram of noise as a motion example will be described below for an original signal, stationary noise, noise estimated in the related art, and noise estimated in this embodiment.

Figure 10:
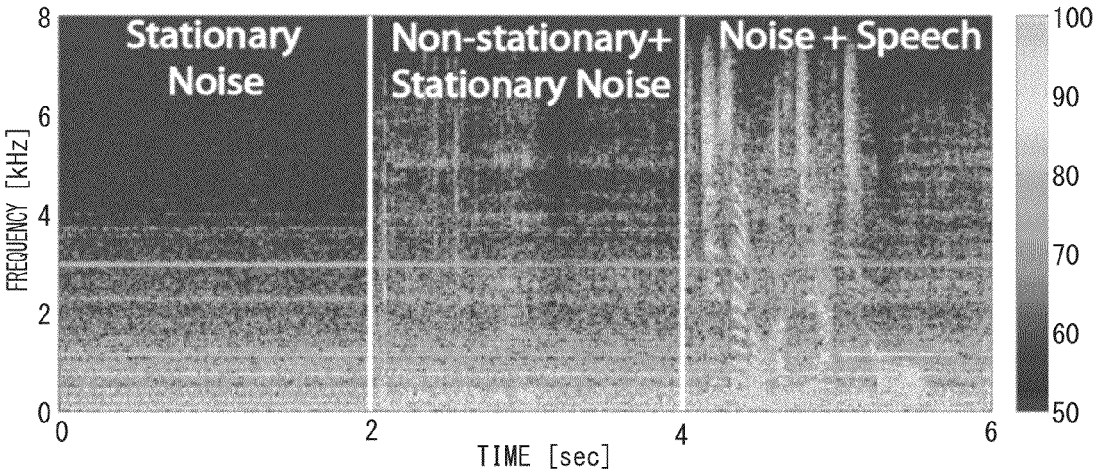
FIG. 10 is a diagram illustrating a spectrogram of an original signal.

FIG. 10 is a diagram illustrating a spectrogram of an original signal.

In FIG. 10, the horizontal axis represents the time and the vertical axis represents the frequency. The power at each frequency and each time is indicated by gradation. The brighter portion means the larger power. In FIG. 10, the "stationary noise" at the time interval of 0 to 2 seconds shows that stationary noise is presented at the interval. The "Non-stationary+Stationary noise" at the time interval of 2 to 4 seconds shows that non-stationary noise and stationary noise are presented at the interval. The "Noise+Speech" at the time interval of 4 to 6 seconds shows that non-stationary noise, stationary noise, and a speech are together presented at the interval.

Figure 11:
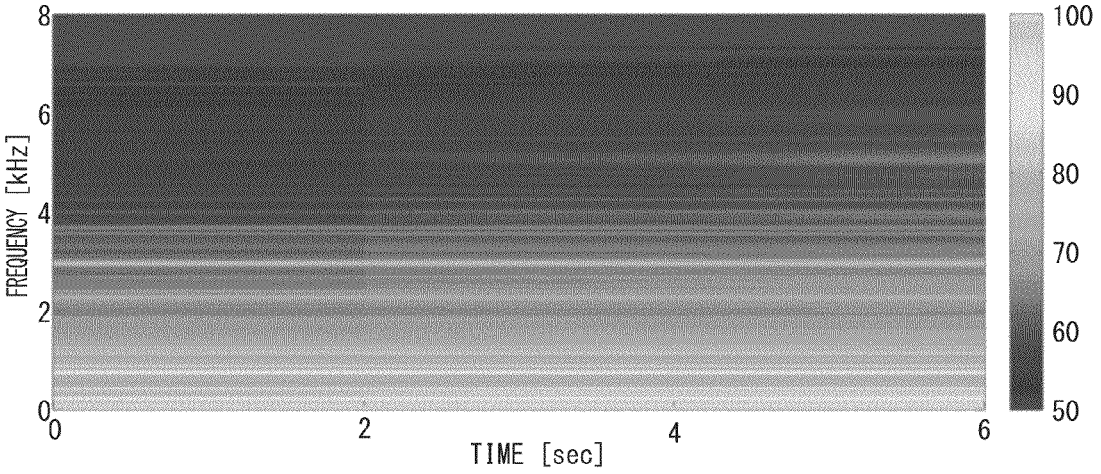
FIG. 11 is a diagram illustrating an example of a spectrogram of stationary noise.

FIG. 11 is a diagram illustrating an example of a spectrogram of stationary noise.

In FIG. 11, the horizontal axis, the vertical axis, and the gradation are the same as shown in FIG. 10. The stationary noise shown in FIG. 11 is stationary noise estimated using the HRLE method. As shown in FIG. 11, the stationary noise estimated using the HRLE method can approximate the stationary noise shown in FIG. 10 or the components based on the stationary noise, but can hardly estimate the non-stationary noise.

Figure 12:
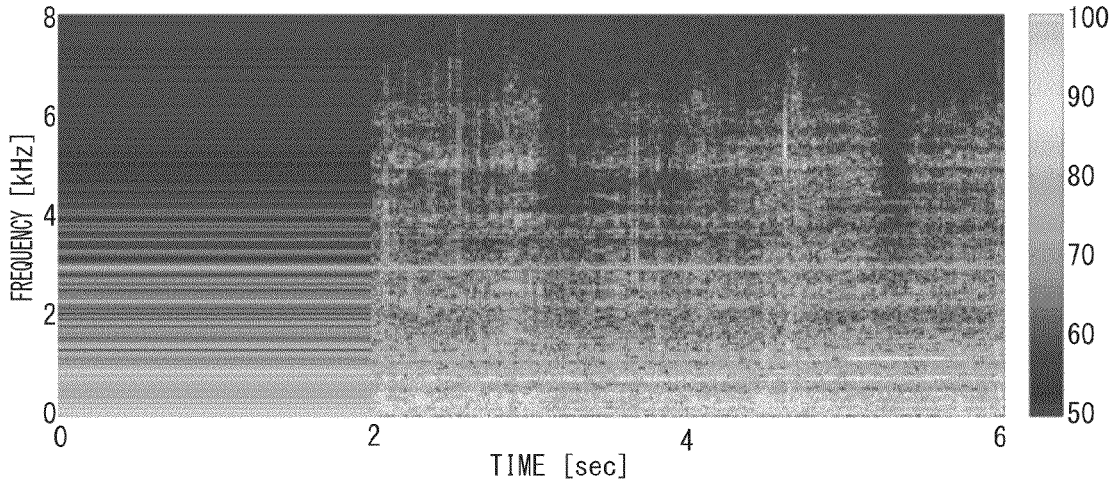
FIG. 12 is a diagram illustrating an example of a spectrogram of estimated noise.

FIG. 12 is a diagram illustrating an example of a spectrogram of estimated noise.

In FIG. 12, the horizontal axis, the vertical axis, and the gradation are the same as shown in FIG. 10. The noise shown in FIG. 12 is noise estimated according to the related art. Comparing FIGS. 12 and 10, the interval (0 to 2 seconds) of only stationary noise and the interval (2 to 4 seconds) at which stationary noise and non-stationary noise are presented approximate each other. However, as can be seen from the frequencies 5 to 6 kHz at the time 4.6 seconds in FIG. 12, the power of a portion mainly including speech is greater than that of the surroundings. This means that noise is erroneously detected when speech is major in the related art.

Figure 13:
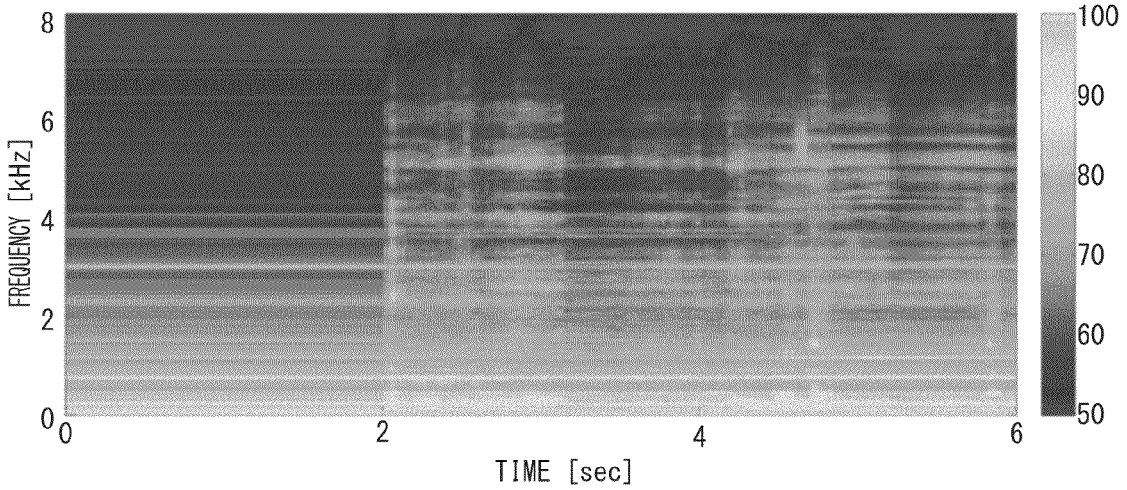
FIG. 13 is a diagram illustrating another example of the spectrogram of estimated noise.

FIG. 13 is a diagram illustrating another example of the spectrogram of the estimated noise.

In FIG. 13, the horizontal axis, the vertical axis, and the gradation are the same as shown in FIG. 10. The noise shown in FIG. 13 is noise estimated according to this embodiment. Comparing FIGS. 13 and 12, the intervals in FIG. 13 are smoother than those in FIG. 12. That is, it is shown that it is possible to more stably estimate noise according to this embodiment. Particularly, the: phenomenon in which the power at the frequency of 5 to 6 kHz at the time 4.6 seconds is higher than that of the surroundings does not occur in FIG. 13. This shows that the influence of a speech in this embodiment is smaller than that in the related art.

The test method and conditions thereof will be described below.

The test was carried out in a room with a length of 4.0 m, a width of 7.0 m, and a height of 3.0 m and with a reverberation time $RT_{20}$ of 0.2 seconds. In the test, sets of motor noise and motion signals (three sets in total for 100 seconds) were used. When motor noise was generated, a participant uttered any of 236 words. In this test, background noise (BGN) was generated in addition to the motor noise and a human speech. In the following description, the test results under the following conditions (1) to (4) will be described. In the condition (1), the energy of background noise was kept constant and the S/N ratio (Signal-to-Noise ratio: SNR) of a speech was 3 dB. In the second condition (2), the energy of background noise was kept constant and the S/R ratio (SNR) of a speech was −3 dB. In the conditions and (4), Gaussian white noise in which the amplitude varies with the lapse of time was added to the condition (2). The Gaussian white noise is a sound source which simulates a non-stationary background noise. The average of the S/N ratios of speeches in the conditions (3) and (4) were −3.1 dB and −3.2 dB, respectively.

Hereinafter, a log-spectral distortion (LSD), a segmental SNR, and a word correct rate (WCR) were used as index values representing the test results.

The LSD is a value obtained by averaging the estimation errors of the estimated power spectrums |X'(k, l)| of sound signals over the overall frequency band with the number of frames L, as expressed by Equation 8.

$$LSD = \frac{1}{L}\sum_{l=1}^{L}\left(\frac{1}{K}\left(\sum_{k=1}^{K}[Lm\{X(k,l)\} - Lm\{X'(k,l)\}]^2\right)\right)^{1/2} \quad (8)$$

In Equation 8, Lm{CC} is max(20 $\log_{10}$|X(k, l)|, δ), where $\delta = \max_{k,l}\{20 \log_{10}|X(k,l)|\} - 50$. That is, Lm{CC} is a function of restricting the dynamic range of CC to a value between the maximum of 20 $\log_{10}$|X(k, l)| and a value smaller by 50 dB than the maximum. Accordingly, the smaller LSD means that it is more excellent.

The segmental SNR is a value obtained by averaging the ratios of an original sound signal to an estimation error within the number of frames L, as expressed by Equation 9. In the following description, the segmental SNR is simply referred to as SNR. Accordingly, the larger SNR means that it is more excellent.

$$SNR = \frac{1}{L}\sum_{l=1}^{L} 10 \cdot \log_{10}\left(\frac{\sum_t x^2(t)}{\sum_t (x(t) - x'(t))^2}\right) \quad (9)$$

The WCR is an accuracy rate of a word of the estimated target sound signal x'(t) recognized by the use of a speech recognition device. The number of words to be recognized was 236, and four males and four females uttered the words. The speech recognition device used in this test had a hidden Markov model (HMM) which is an acoustic model and a word dictionary. The speech recognition device was made to learn in advance by the use of Japanese newspaper article sentences (JNAS) corpus. The JNAS corpus included speech data of 60 hours uttered by 306 speakers. Accordingly, the words and the speakers were all unspecified. The sound feature values extracted from a sound signal by the use of the speech recognition device include 13 static Mel-scale log spectrum (MSLS), 13 delta MSLS, and one delta power. Accordingly, the higher WCR means that it is more excellent.

FIG. 14 is a table illustrating an example of the test result.

The rows in FIG. 14 show that the NNEE, the LSD, the SNR, and the WCR were used as the index values. The columns show signals to be evaluated under the condition (1) and the condition (2). A non-processed input signal (non-processed), a sound signal (HRLE) from which stationary noise estimated using the HRLE method is removed, a sound signal (TE) estimated using the template estimation method according to the related art, and a sound signal (the embodiment) estimated according to this embodiment are sequentially shown from the left-most column to the right. The numerical values indicated by bold characters are numerical values related to signals indicating that the estimation accuracy is the most excellent out of the signals to be evaluated.

In the condition (1), it could be seen that all the index values in this embodiment were the most excellent. In the condition (2), the NNEE, the LSD, and the WCR in this embodiment were the most excellent and the SNR was excellent next to the TE. Here, the SNR in the TE was 5.49 dB and the SNR in this embodiment was 5.24 dB, but the difference therebetween was merely 0.25 dB.

FIG. 15 is a table illustrating another example of the test result.

The rows in FIG. 15 show that the NNEE, the LSD, the SNR, and the WCR were used as the index values. The columns show signals to be evaluated under the condition (3) and the condition (4). Non-processed, HRLE, TE, and this embodiment are sequentially shown from the left-most column to the right. The numerical values indicated by bold characters are numerical values related to signals indicating that the estimation accuracy is the most excellent out of the signals to be evaluated.

In the conditions (3) and (4), it could be seen that all the index values in this embodiment were the most excellent. Accordingly, it could be seen from the result that this embodiment is more robust against the variation in noise than other methods.

Although it has been stated in the above-mentioned embodiment that the process (step S320) of creating a target sound signal x'(t) is performed when the speech determining unit 1381 determines that the input sound signal y(t) is in a non-speech segment (NO in step S304), this embodiment is not limited to this configuration. In this embodiment, the process (step S320) of creating a target sound signal x'(t) may be performed regardless of the result that the speech determining unit 1381 determines that the input sound signal y(t) is in the non-speech segment.

Although it has been stated in the above-mentioned embodiments that the motion detection unit 12 creates a motion signal of a mechanical apparatus equipped with the sound processing device 1 or 2, for example, a motion signal of a robot, the above-mentioned embodiments are not limited to this configuration. The motion detecting unit 12 is not particularly limited as long as it can operate while the sound processing device 1 processes the sound signal and can radiate motor noise to the surroundings. An example of such a mechanical apparatus is a vehicle equipped with an engine, a DVD player (Digital Versatile Disk Player), an HDD (Hard Disk Drive), and the like. That is, the sound processing device 1 may be mounted on a mechanical apparatus which is a motion control target and which cannot directly pick up sound generated due to the motion.

The motion detecting unit 12 may receive instruction signals (such as instruction data and commands) indicating instructions such as start and stop of a motion of such a mechanical apparatus and change of the motion pattern from the mechanical apparatus. In this case, the motion detecting unit 12 determines whether or not the input instruction signal is an instruction signal (ego-noise instruction signal) instructing the mechanical apparatus to create ego-noise. The motion detecting unit 12 outputs the motion signal to the template estimating unit 1332 or 2332 and the template updating unit 1383 or 2383, when it is determined that the input instruction signal is the ego-noise instruction signal.

Here, the motion detecting unit 12 stores the ego-noise instruction signal, for example, in a storage unit of the motion detecting unit 12 in advance. When an ego-noise instruction signal matched with the input instruction signal is stored in the storage unit, the motion detecting unit 12 determines that the input instruction signal is the ego-noise instruction signal. When an ego-noise instruction signal matched with the input instruction signal is not stored, the motion detecting unit 12 determines that the input instruction signal is an ego-noise instruction signal. For example, when the mechanical apparatus is a robot, examples of the ego-noise instruction signal include an instruction signal instructing the rotation of a motor driving a partial configuration or an instruction signal instructing the motion of a fan cooling the motor. That is, the motor noise generated with the rotation of the motor or the motion of the fan is considered as ego noise. For example, when the mechanical apparatus is a vehicle, examples of the ego-noise instruction signal include an instruction signal instructing the rotation or acceleration of an engine. That is, noise generated with the rotation of the engine or the driving of the vehicle or wind noise is considered as ego noise.

Accordingly, the template updating unit 1383 or 2383 performs the process of updating the template when it is determined that the input instruction signal is the ego-noise instruction signal. That is, the template updating unit 1383 or 2383 creates a template including the data based on the motion signal and the sound feature value based on the ego noise and stores the created template in the template storage unit 134. The template estimating unit 1332 or 2332 estimates sound feature values of components based on the ego noise using the created templates as search targets. Accordingly, the sound processing device 1 or 2 removes the sound feature values of the components based on the estimated ego noise from the sound feature values of the input sound signal.

A part of the sound processing devices 1 and 2 according to the above-mentioned embodiments, such as the frequency domain conversion unit 131, the power calculating unit 132, the noise estimating units 133 and 233, the subtraction unit 135, the gain calculating unit 1351, the filter unit 1352, the template creating units 138 and 238, and the template reconstructing unit 139, may be embodied by a computer. In this case, the various units may be embodied by recording a program for performing the control functions in a computer-readable recording medium and by causing a computer system to read and execute the program recorded in the recording medium. Here, the "computer system" is built in the sound processing devices 1 and 2, and includes an OS or hardware such as peripherals. Examples of the "computer-readable recording medium" include memory devices of portable mediums such as a flexible disk, a magneto-optical disc, a ROM, and a CD-ROM, a hard disk built in the computer system, and the like. The "computer-readable recording medium" may include a recording medium dynamically storing a program for a short time like a transmission medium when the program is transmitted via a network such as the Internet or a communication line such as a phone line and a recording medium storing a program for a predetermined time like a volatile memory in a computer system serving as a server or a client in that case. The program may embody a part of the above-mentioned functions. The program may embody the above-mentioned functions in cooperation with a program previously recorded in the computer system.

In addition, part or all of the sound processing devices 1 and 2 according to the above-mentioned embodiments may be embodied as an integrated circuit such as an LSI (Large Scale Integration). The functional blocks of the sound processing devices 1 and 2 may be individually formed into processors and a part or all thereof may be integrated as a single processor. The integration technique is not limited to the LSI, but they may be embodied as a dedicated circuit or a general-purpose processor. When an integration technique taking the place of the LSI appears with the development of semiconductor techniques, an integrated circuit based on the integration technique may be employed.

While an embodiment of the invention has been described in detail with reference to the drawings, practical configurations are not limited to the above-described embodiment, and design modifications can be made without departing from the scope of this invention.

What is claimed is:

1. A sound processing device comprising:

a storage unit configured to store first operation data corresponding to a motion of a mechanical apparatus and a first sound feature value corresponding to the motion in correlation with each other;

a noise estimating unit configured to estimate a third sound feature value corresponding to a noise component based on a second sound feature value corresponding to an acquired sound signal;

a sound feature value processing unit configured to calculate a target sound feature value from which the noise component is removed based on the second sound feature value and the third sound feature value; and an updating unit configured to update the first sound feature value stored in the storage unit based on detected second operation data and the third sound feature value estimated by the noise estimating unit.

2. The sound processing device according to claim 1, wherein the updating unit is configured to select the first sound feature value stored in the storage unit based on the second operation data, and to update the first sound feature value to a value obtained by multiplying the first sound feature value and the third sound feature value by corresponding weighting coefficients and adding the multiplied values.

3. The sound processing device according to claim 1, wherein the updating unit is configured to store the second operation data and the third sound feature value estimated by the noise estimating unit in the storage unit in correlation with each other when the degree of similarity between the second operation data and the first operation data stored in the storage unit is lower than a predetermined degree of similarity.

4. The sound processing device according to claim 1, further comprising a speech determining unit configured to determine whether the sound signal is a speech signal or a non-speech signal, wherein the noise estimating unit includes a stationary noise estimating unit configured to estimate a sound feature value of a stationary noise component based on the sound signal when the speech determining unit determines that the sound signal is a non-speech signal, and wherein the updating unit is configured to update the first sound feature value based on a non-stationary component from which the sound feature value of the stationary noise component estimated by the stationary noise estimating unit based on the second sound feature value as the noise component is removed.

5. The sound processing device according to claim 1, further comprising a motion detecting unit configured to determine whether or not an instruction data corresponds to a motion causing the mechanical apparatus to generate ego-noise when the instruction data related to the motion is input to the mechanical apparatus, wherein the noise estimating unit is configured to estimate the third sound feature value based on the second sound feature value when the motion detecting unit determines that the instruction data corresponds to the motion causing the mechanical apparatus to generate ego-noise, and wherein the updating unit is configured to update the first sound feature value based on a component obtained by subtracting the third sound feature value estimated by the noise estimating unit from the second sound feature value.

6. A sound processing method in a sound processing device having a storage unit configured to store first operation data corresponding to a motion of a mechanical apparatus and a first sound feature value corresponding to the motion in correlation with each other, comprising the steps of:

estimating a third sound feature value corresponding to a noise component based on a second sound feature value corresponding to an acquired sound signal;

calculating a target sound feature value from which the noise component is removed based on the second sound feature value and the third sound feature value; and updating the first sound feature value stored in the storage unit based on detected second operation data and the third sound feature value.

7. A sound processing program causing a computer of a sound processing device, which has a storage unit configured to store first operation data corresponding to a motion of a mechanical apparatus and a first sound feature value corresponding to the motion in correlation with each other, to perform the steps of:

estimating a third sound feature value corresponding to a noise component based on a sound feature value of an acquired sound signal;

calculating a target sound feature value from which the noise component is removed based on a second sound feature value corresponding to the sound signal and the third sound feature value; and updating the first sound feature value stored in the storage unit based on detected second operation data and the third sound feature value.

* * * * *